US005897166A

United States Patent [19]

Tsai

[11] Patent Number: 5,897,166

[45] Date of Patent: Apr. 27, 1999

[54] CHAIR

[76] Inventor: Son-Chun Tsai, No. 908, Nan-Pin Rd., West Castle Village, Ta-Cheng Hsaing, Changhua County, Taiwan

[21] Appl. No.: 09/064,909

[22] Filed: Apr. 23, 1998

[51] Int. Cl.[6] ..... A47C 1/00

[52] U.S. Cl. ..... 297/353; 297/383

[58] Field of Search ..... 297/353, 383, 297/411.36, 411.37

[56] References Cited

U.S. PATENT DOCUMENTS

| | | | |
|---|---|---|---|
| 2,973,031 | 2/1961 | Cramer, Jr. | 297/383 |
| 3,326,602 | 6/1967 | Moore et al. | 297/353 X |
| 4,043,594 | 8/1977 | Cabell | 297/353 |
| 4,099,774 | 7/1978 | Sandham | 297/353 X |
| 5,035,466 | 7/1991 | Mathews et al. | 297/353 X |
| 5,542,743 | 8/1996 | Olson et al. | 297/353 |
| 5,575,534 | 11/1996 | Yu | 297/353 X |

*Primary Examiner*—Jose V. Chen
*Assistant Examiner*—Stephen Vu
*Attorney, Agent, or Firm*—Rosenberg, Klein & Bilker

[57] ABSTRACT

A chair includes a base to which a seat member is disposed, an L-shaped connecting plate extending from the base and a back member disposed to an upper end of the connecting plate. A mediate member is disposed to the base 10 and has two guides and each guide has a first slot defined longitudinally therethrough. The connecting plate has a transverse bar fixedly connected to a lower end thereof and the transverse bar is slidably received between the two first slots. An operation rod extends through the mediate member and an aperture defined in the lower end of the connecting plate so that the connecting plate is slidable and pivotable within the two first slots when removing the operation rod from the aperture of the connecting plate.

6 Claims, 9 Drawing Sheets

CHAIR

BACKGROUND OF THE INVENTION

1. Field of the Invention

The present invention relates to a chair comprising a base on which a seat member is adjustably disposed and a connecting plate slidably and pivotally extending from the base to which a back member is movably disposed. The connecting plate is pivoted about the base so as to lower the back member.

2. Brief Description of the Prior Art

Chairs, especially for chairs used in office, for example a swivel chair, includes a seat member rotatably supported on a base and a back member which is connected to a connecting plate extending from the base. The seat member can be adjusted its height from the ground and the connecting plate generally has a slight flexibility nature so that when a person sits in the chair, his/her weight can apply on the back member and the connecting plate will be pushed rearwardly. However, basically, such a chair has a fixed configuration, that is to say, the back member of the chair can only be adjusted within a limited range and the seat member cannot be adjusted. Furthermore, chairs especially designed for operating computers are presented in the market recently and most of the offices are equipped with various types of computers so that the computer chairs are widely needed in the future. That is to say, such computer chair has a higher seat member and a lower member, a user sits on the higher seat member and keens on the lower member so as to reduce pressure on the user's spine. Therefore, the conventional chairs cannot meet the requirements of a modern office should have.

The present invention provides an improved chair which has a base on which a seat member is disposed and a connecting plate slidably and pivotally extending from the base, a back member disposed to the connecting plate so that the back member can be lowered by pivoting the connecting

SUMMARY OF THE INVENTION

In one aspect of the present invention, there is provided a chair comprising a base having a seat member disposed thereto, an L-shaped connecting plate extending form the base and a back member disposed to an upper end of the connecting member. A mediate member is disposed to the base and has two guides extending upwardly from two opposite sides thereof, each guide having a first slot defined longitudinally therethrough. The connecting plate has a transverse bar fixedly connected to a lower end thereof and is slidably received between the two guides. The transverse bar is slidably received between the two first slots of the two guides. An operation rod extends through the mediate member and an aperture defined in the lower end of the connecting plate so that the connecting plate is slidable and pivotable within the two first slots when removing the operation rod from the aperture 220.

It is an object of the present invention to provide a chair which has a connecting plate disposed between a base and a back member, the connecting plate can be pivoted downwardly corresponding to the seat member.

It is another object of the present invention to provide a chair wherein the seat member is pivotally connected to the base.

It is a further object of the present invention to provide a chair which can be adjusted to be a computer chair.

How these and other objects are accomplished will become apparent from the following descriptions and from the drawings.

DETAILED DESCRIPTION OF THE PREFERRED EMBODIMENT

Figure 1:
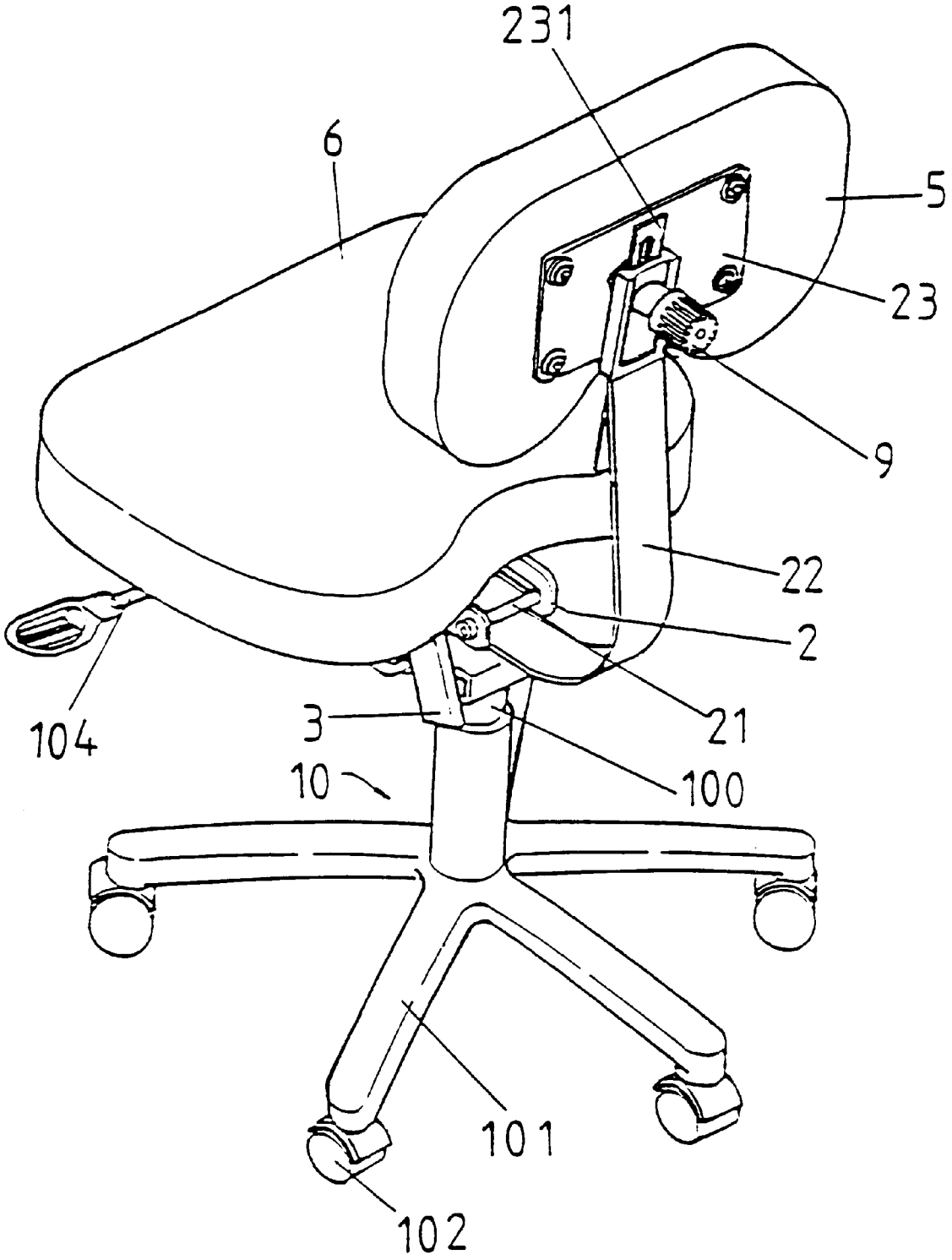
FIG. 1 is a perspective view of a chair in accordance with the present invention.
Figure 2:
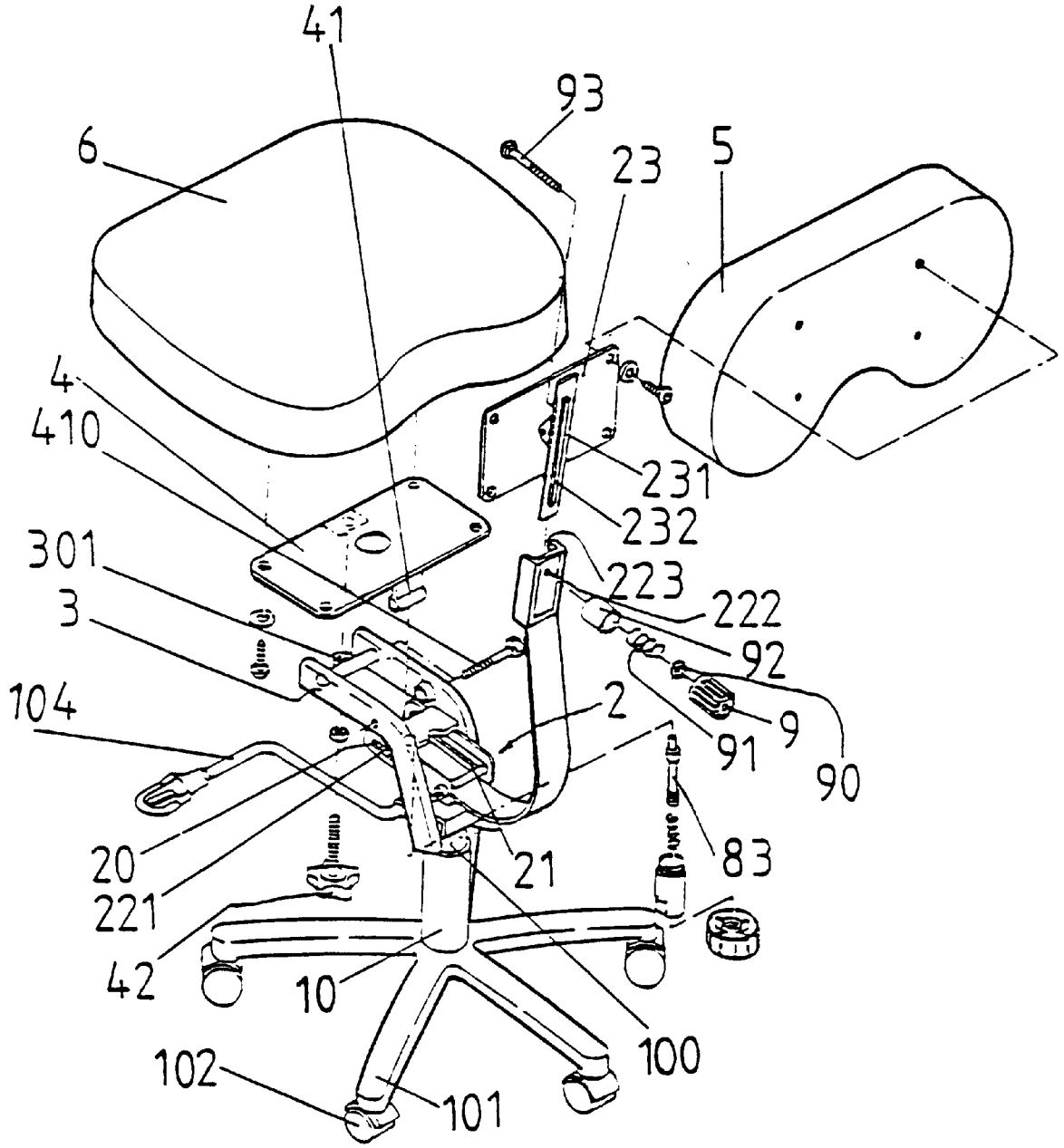
FIG. 2 is an exploded view of the chair in accordance with the present invention.
Figure 3:
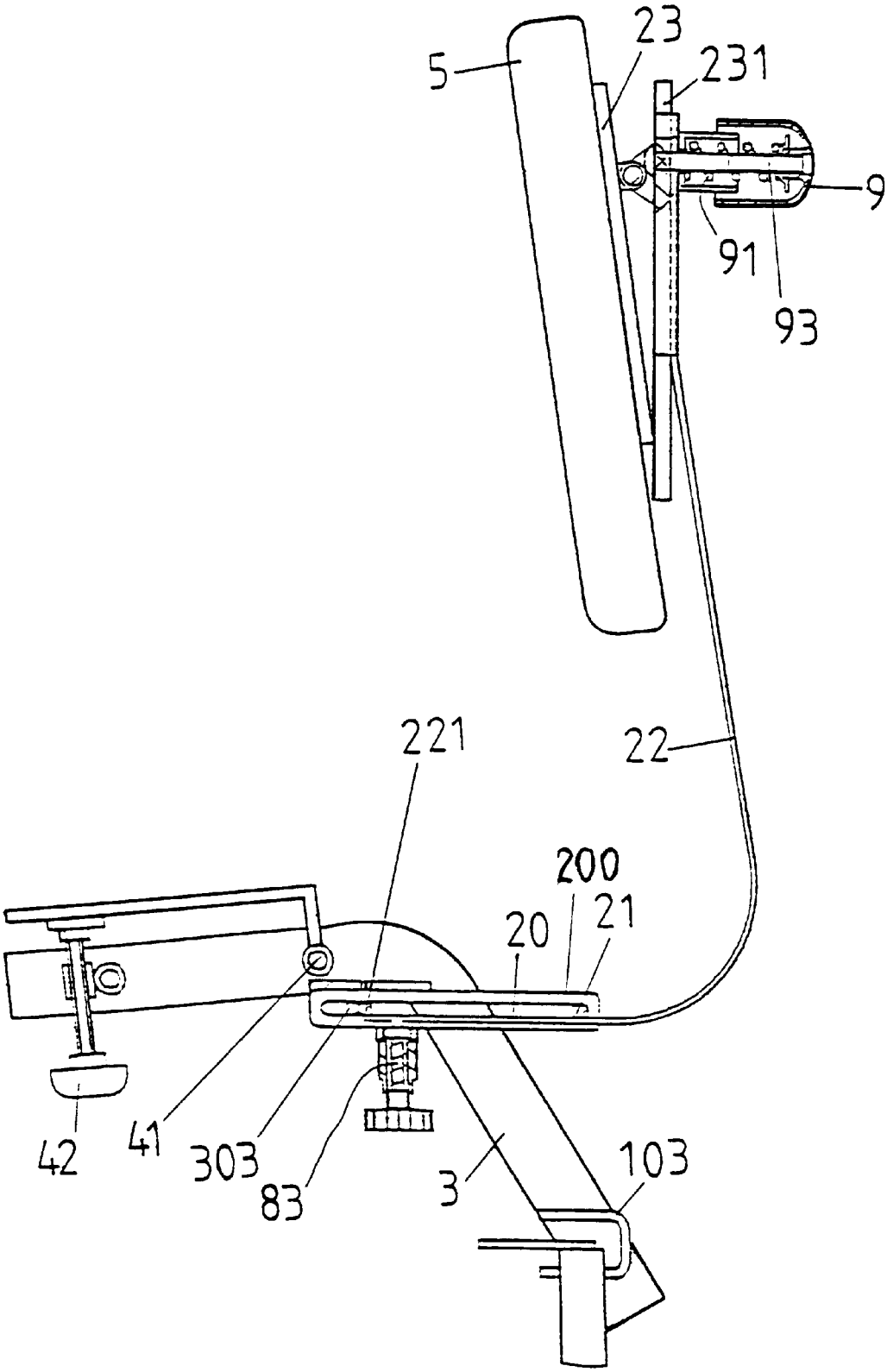
FIG. 3 is a side illustrative view of the chair of the present invention.

Referring to the drawings and initially to FIGS. 1 through 3, a chair in accordance with the present invention generally includes a base 10 having a seat member 6 disposed thereto, an L-shaped connecting plate 22 extending from the base 10 and a back member 5 disposed to an upper end of the connecting plate 22. The base 10 has a plurality of extending members 101 extending therefrom and each the extending member 101 has a wheel 102 disposed to an underside thereof. A nitrogen air bag means 100 is disposed between the base 10 and the seat member 6, and a control handle 104 is connected to the nitrogen air bag means 100 so as to adjust a height of the seat member 6 from the ground.

Figure 4:
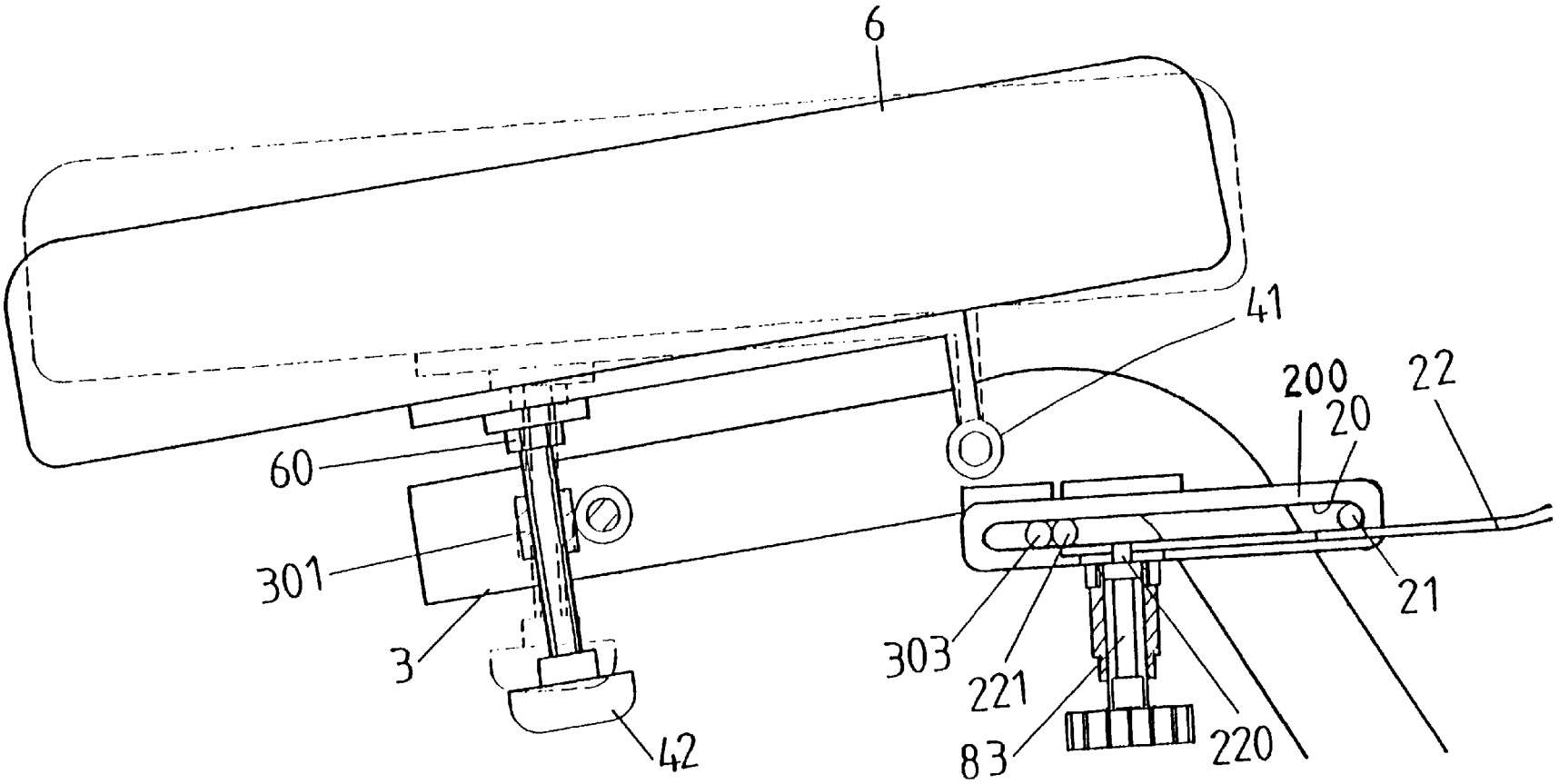
FIG. 4 is an illustrative view to show the seat member of the chair is adjusted.
Figure 5:
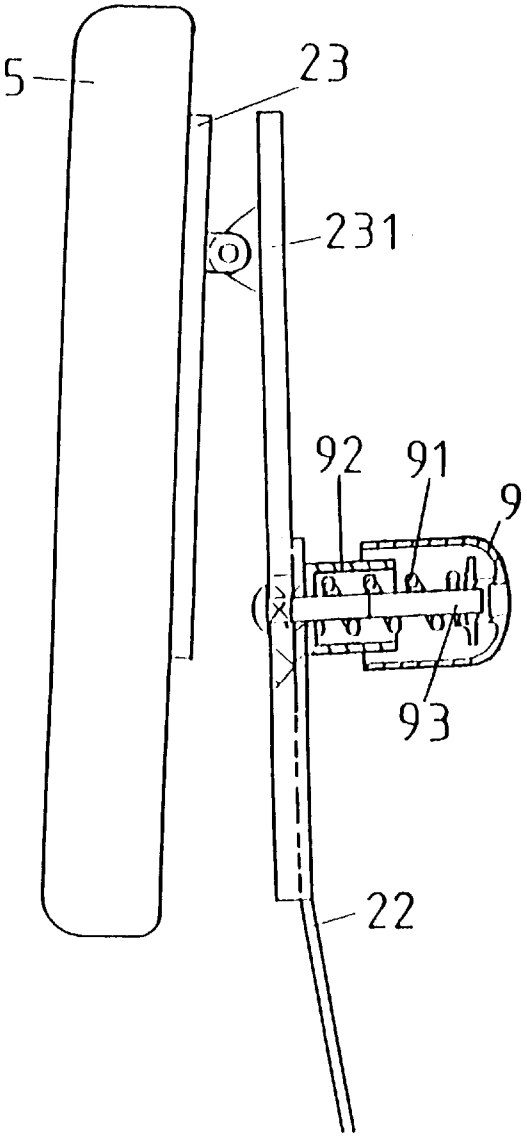
FIG. 5 is an illustrative view to show a position of the back member is adjusted.
Figure 6:
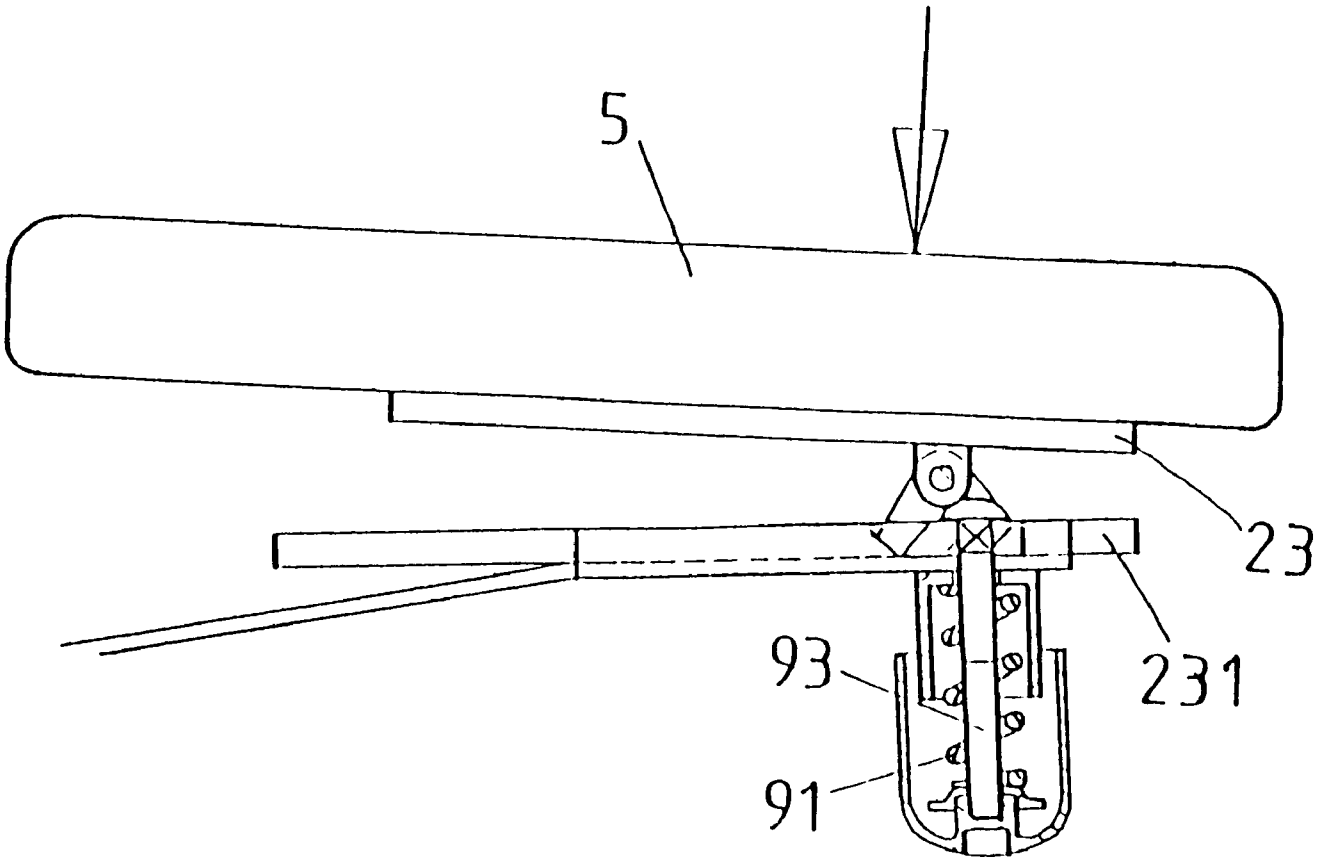
FIG. 6 is an illustrative view to show when the back member is pressed to actuate the spring disposed to a rear side thereof.

The base 10 has two side rails 3 extending therefrom on which a first board 4 is pivotally disposed. The first board 4 has a tubular member 41 disposed thereto and a pin 410 extends through the two rails 3 and the tubular member 41 so that the seat member 6 is pivotally connected to the two rails 3. A first bolt 42 extends through a supporting member 301 fixedly connected between the two rails 3, the first board 4 and is detachably and threadedly connected to a receiving socket 60 (see FIG. 4) disposed to an underside of the seat member 6. Therefore, referring to FIG. 4 again, the seat member 6 is adjusted and pivoted about an axis of the pin 410 by threading the first bolt 42.

A mediate member 2 is disposed to the base 10 and extends between the two rails 3, and has two guides 200 extending upwardly from two opposite sides thereof and each guide 200 has a first slot 20 defined longitudinally therethrough. A front stop 303 and a rear stop 21 are respectively disposed transversely in the two first slots 20.

Figure 7:
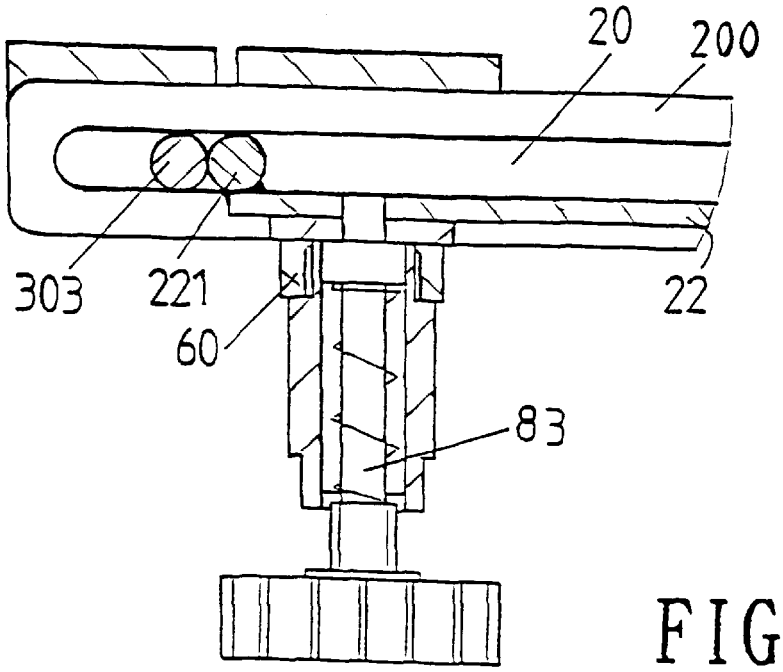
FIG. 7 is a side elevational view, partly in section, of a part of the mediate member and the connecting member when an operation rod is not yet pulled downwardly.
Figure 8:
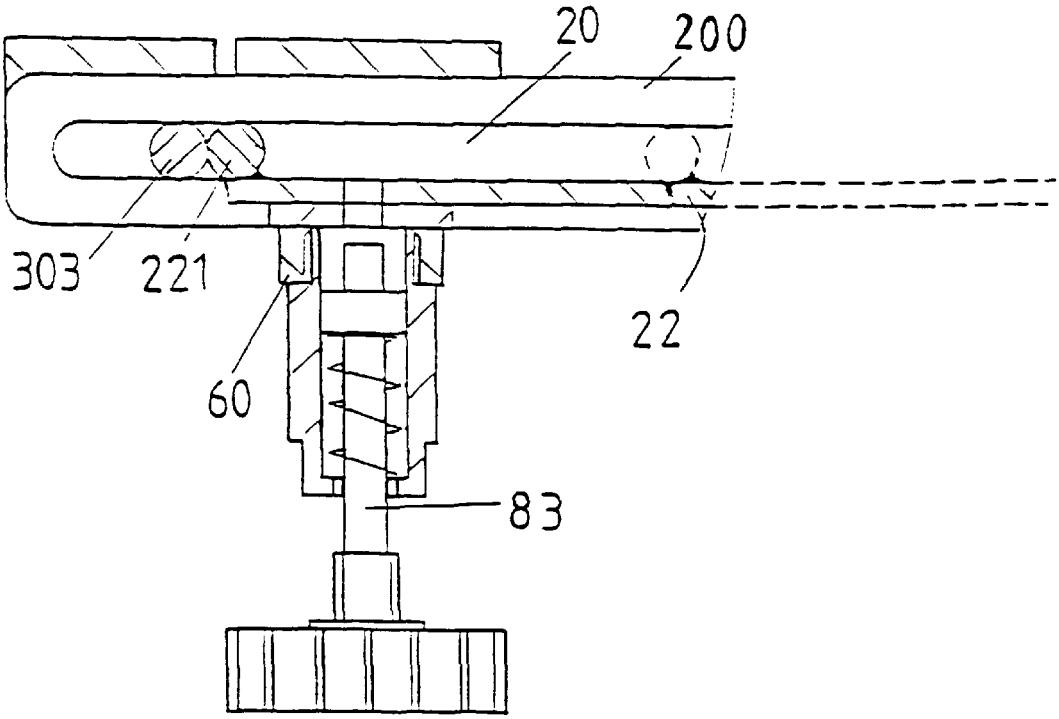
FIG. 8 is a side elevational view, partly in section, of the part of the mediate member and the connecting member as shown in FIG. 7 when the operation rod is pulled downwardly.

Referring to FIGS. 7 and 8, the L-shaped connecting plate 22 has a transverse bar 221 fixedly connected to a lower end thereof and the transverse bar 221 is slidably received between the two first slots 20 of the two guides 200 so that the connecting plate 22 is slidably received between the two guides 200. An operation rod 83 extends through the mediate member 2 and an aperture 220 defined in the lower end of the connecting plate 22 so that the connecting plate 22 is slidable and pivotable within the two first slots 20 when removing the operation rod 83 from the aperture 220.

A second board 23 is fixedly disposed to a rear side of the back member 5 and an elongate plate 231 is pivotally connected to the second board 23. The connecting plate 22 has a hole 222 define through the upper end thereof and two ridges 223 extending from two opposite sides of the upper end of the connecting plate 22 so that the elongate plate 231 is slidably received between the two ridges 223. The elongate plate 231 has a second slot 232 defined therethrough so that a second bolt 93 extends through the second slot 232 and the hole 222 and is fixedly connected to a cap 9 with a spring 91 mounted to the second bolt 93. A tube 92 is disposed to a side of the elongate plate 231 and the second bolt 93 extends through the tube 92 which is partially received in the cap 9 so that when the back member 5 is pressed by a weight of a person which sits in the chair, the second board 23 together with the elongate plate 231 and the tube 92 depress the spring 91 to provide a comfortable condition.

Figure 9:
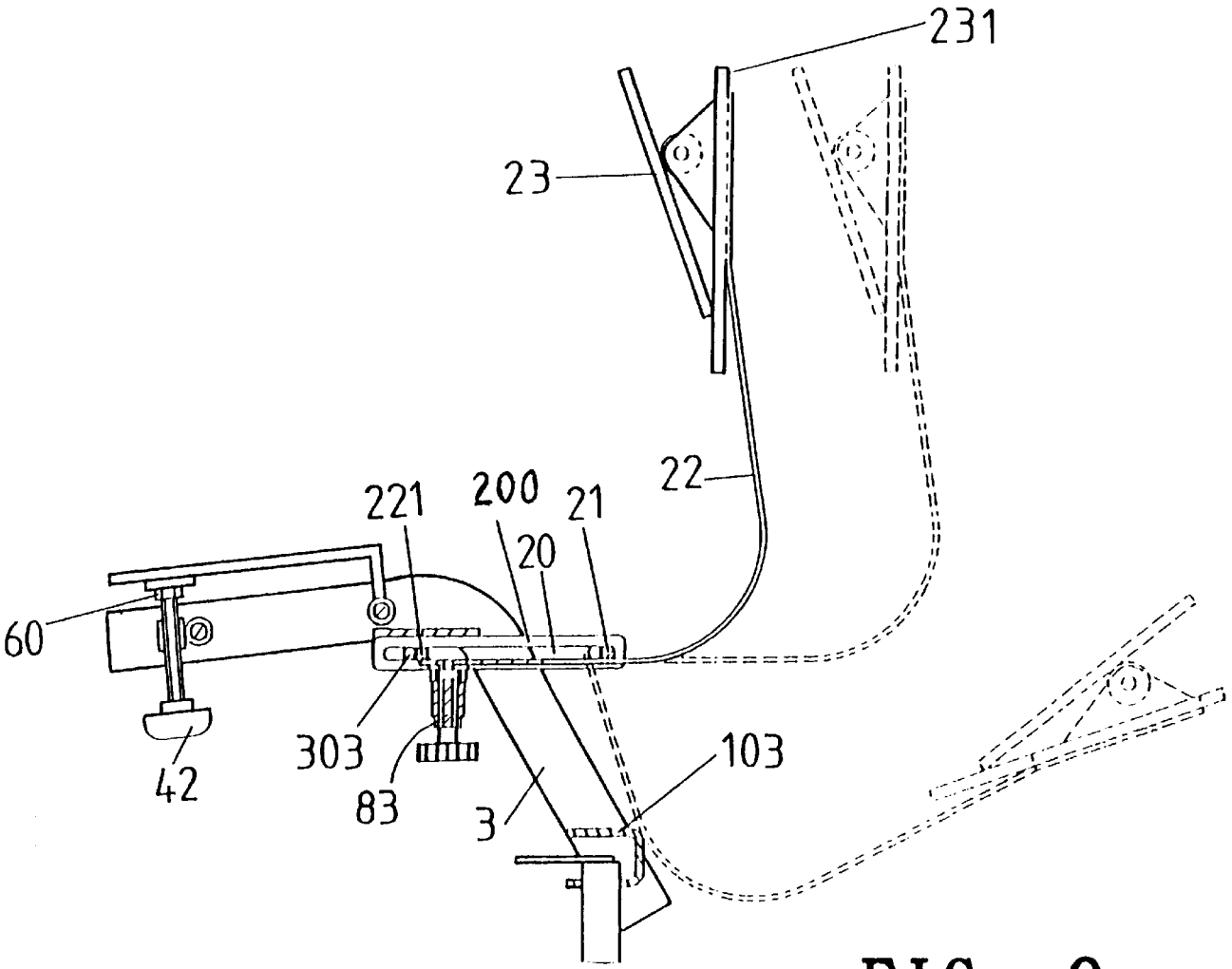
FIG. 9 is an illustrative view to show the connecting plate is pivoted corresponding to the seat member.
Figure 10:
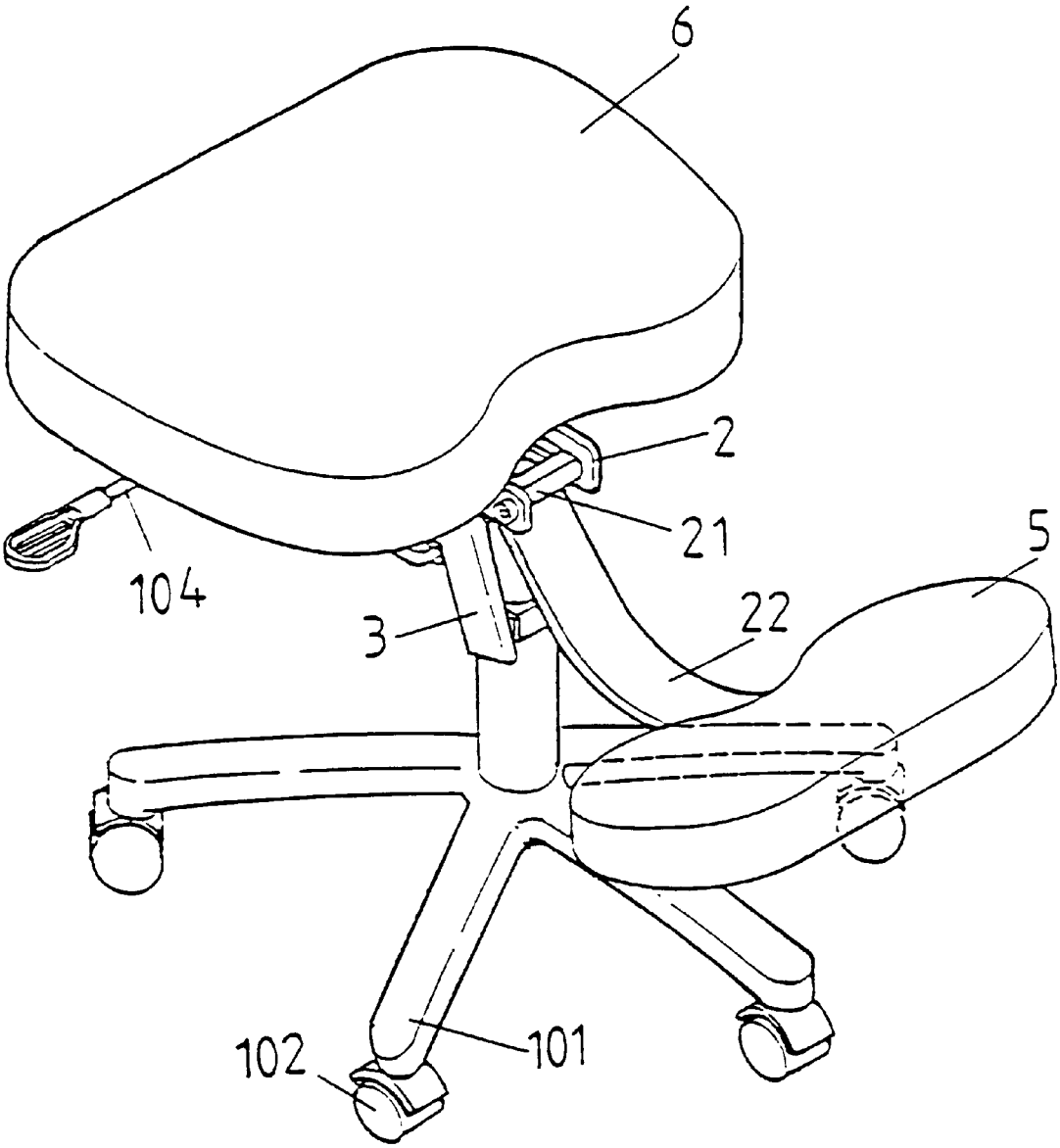
FIG. 10 is a perspective view to show the chair after the connecting plate is adjusted to a lower position and to form a computer chair.

Referring to FIGS. 9 and 10, when transforming the chair into a computer chair, the operation rod 83 is first pulled downwardly to disengage from the aperture 220 defined in the lower end of the connecting plate 22 and the connecting plate 22 is then pulled within the slots 20 towardly a rear end of the chair till the transverse bar 221 is stopped by the rear stop 21. The connecting plate 22 together with the back member 5 are then pivoted downwardly about an axis of the transverse bar 221 till the connecting plate 22 is stopped by a frame 103 extending from the base 10. Therefore, the user may sit on the seat member 6 and knee on the back member 5 to operate a computer, and the seat member 6 is pivoted about the pin 410 to adjust the seat member 6 to a desired inclined position corresponding to the ground.

Accordingly, the chair of the present invention has a unique structure and can be conveniently transformed to a computer chair such that the chair involves two main functions and is different from those presented in the market.

While particular embodiments of the present invention have been illustrated and described herein, it is not a intended to limit the invention and changes and modifications may be made therein within the scope of the invention as hereinafter claimed.

What is claimed is:

1. A chair comprising:

a base having a seat member disposed thereto and two side rails extending therefrom on which a first board is pivotally disposed, said first board having a tubular member disposed thereto and a pin extending through said two rails and said tubular member, a supporting member fixedly connected between said two rails and a first bolt extending through said supporting member, said first board detachably connected to an underside of said seat member;

a mediate member disposed to said base and having two guides extending upwardly from two opposite sides thereof and each guide having a first slot defined longitudinally therethrough;

an L-shaped connecting plate slidably received between said two guides and having a transverse bar fixedly connected to a lower end thereof, said transverse bar slidably received between said two first slots of said two guides, an operation rod extending through said mediate member and an aperture defined in said lower end of said connecting plate so that said connecting plate is slidable and pivotable within said two first slots when removing said operation rod from said aperture, and a back member disposed to an upper end of said connecting plate.

2. The chair as claimed in claim 1 wherein said base further has a frame extending therefrom such that said connecting plate is stopped by said frame when said connecting plate together with said back member are pivoted downwardly.

3. The chair as claimed in claim 2 wherein said back member is lower than said seat member when said connecting plate and said back member are pivoted downwardly.

4. The chair as claimed in claim 1 wherein said base has a plurality of extending members and each of said extending members has a wheel disposed to an underside thereof.

5. The chair as claimed in claim 1 wherein said connecting plate has a hole define through said upper end thereof, said back member having an elongate plate fixedly connected to a rear side thereof and said plate having a second slot defined therethrough so that a second bolt extends through said second slot and said hole.

6. The chair as claimed in claim 5 wherein a second board is fixedly disposed to said rear side of said back member and said elongate plate is pivotally connected to said second board, a cap fixedly connected to said second bolt with a spring mounted to said second bolt so that said spring is biased between said cap and said elongate plate.

* * * * *